US005100034A

United States Patent [19]

Russo

[11] Patent Number: 5,100,034

[45] Date of Patent: Mar. 31, 1992

[54] MOLTEN METAL SLIDE GATE VALVE

[75] Inventor: Thomas J. Russo, Kingsville, Md.

[73] Assignee: Bethlehem Steel Corporation, Bethlehem, Pa.

[21] Appl. No.: 674,481

[22] Filed: Mar. 25, 1991

Related U.S. Application Data

[63] Continuation-in-part of Ser. No. 509,683, Apr. 16, 1990, Pat. No. 5,004,131.

[51] Int. Cl.[5] ..... B22D 41/08

[52] U.S. Cl. ..... 222/600; 222/603

[58] Field of Search ..... 222/600, 603; 266/217, 266/220, 265

[56] References Cited

U.S. PATENT DOCUMENTS 5,004,131 4/1991 Russo ..... 222/600

5,020,703 6/1991 McQuillen, Jr. et al. ..... 222/590

*Primary Examiner*—Scott Kastler

*Attorney, Agent, or Firm*—John I. Iverson

[57] ABSTRACT

A molten metal slide gate valve for use on a ladle or tundish. The slide gate valve uses a refractory plate or plates having a shallow groove all around the periphery of one or both surfaces of the plate. The groove surrounds the molten metal orifice in the plate. The base of the groove has a porous refractory insert connected to a source of nonoxidizing gas under pressure to provide a nonoxidizing gas seal all around the molten metal orifices in the slide gate valve and to prevent the aspiration of air into the molten metal orifices during discharge of the molten metal from the ladle or tundish.

5 Claims, 2 Drawing Sheets

MOLTEN METAL SLIDE GATE VALVE

RELATED APPLICATION

This application is a continuation-in-part of U.S. patent application Ser. No. 509,683 filed Apr. 16, 1990 for "Molten Metal Slide Gate Valve" now U.S. Pat. No. 5,004,131.

BACKGROUND OF THE INVENTION

This invention relates to the pouring of molten metal from a ladle or tundish into a receiving vessel, such as a mold of a continuous casting machine. It relates particularly to improvements in the construction of a molten metal slide gate valve commonly used to control the flow of molten metal from the bottom of a ladle or tundish.

Sliding gate valves for molten metal are generally comprised of stationary upper and lower refractory plates each having a sized molten metal orifice and a reciprocable refractory slide plate in between the upper and lower plates. The reciprocable slide plate also has a sized molten metal orifice which, as the slide plate is reciprocated, moves in and out of registry with the molten metal orifices in the top and bottom plates to either open or close the valve to the flow of molten metal. A discharge nozzle is usually mounted below the lower stationary plate in alignment with the lower plate molten metal orifice to direct the stream of molten metal into a mold or other vessel. The refractory plates are all mounted in a steel frame attached to the bottom of the ladle or tundish and a hydraulic or pneumatic cylinder is used to reciprocate the middle slide plate.

While the refractory plates are held tightly together in the steel frame with springs, it has been noted that air is still capable of being drawn into the molten metal orifices in the plates which causes oxidation of the molten metal as it is being discharged through the sliding gate valve. If the molten metal is aluminum-killed steel, the aluminum in the steel will be oxidized forming particles of alumina which adhere to the discharge nozzle or remain in the steel as harmful inclusions.

Past attempts to prevent the infiltration of air into the sliding gate valve or by flooding the area around the plates have not been successful in preventing the infiltration of air into the plate orifices.

SUMMARY OF THE INVENTION

It is therefore an object of this invention to provide a sliding gate molten metal valve which greatly reduces the infiltration of air into the molten metal orifices of the refractory plates.

It is a further object of this invention to provide apparatus that will greatly reduce the amount of aluminum oxides found in the molten steel as it is poured from a ladle into a tundish or into a continuous casting machine.

I have discovered the foregoing objects can be attained by using a refractory slide gate valve member having a molten metal orifice and an open shallow groove in at least one face of the plate which extends around the entire periphery of the orifice and having porous refractory means in the base of the groove for introducing a uniform flow of nonoxidizing gas into the groove.

DESCRIPTION OF A PREFERRED EMBODIMENT

Figure 1:
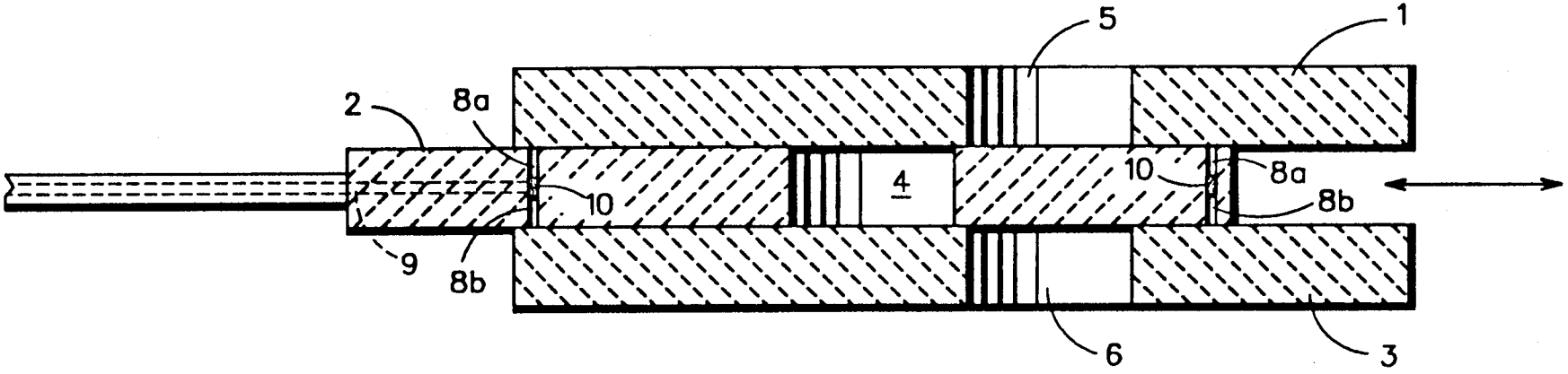
FIG. 1 is a schematic sectional elevation view of one type of sliding gate valve of this invention.
Figure 2:
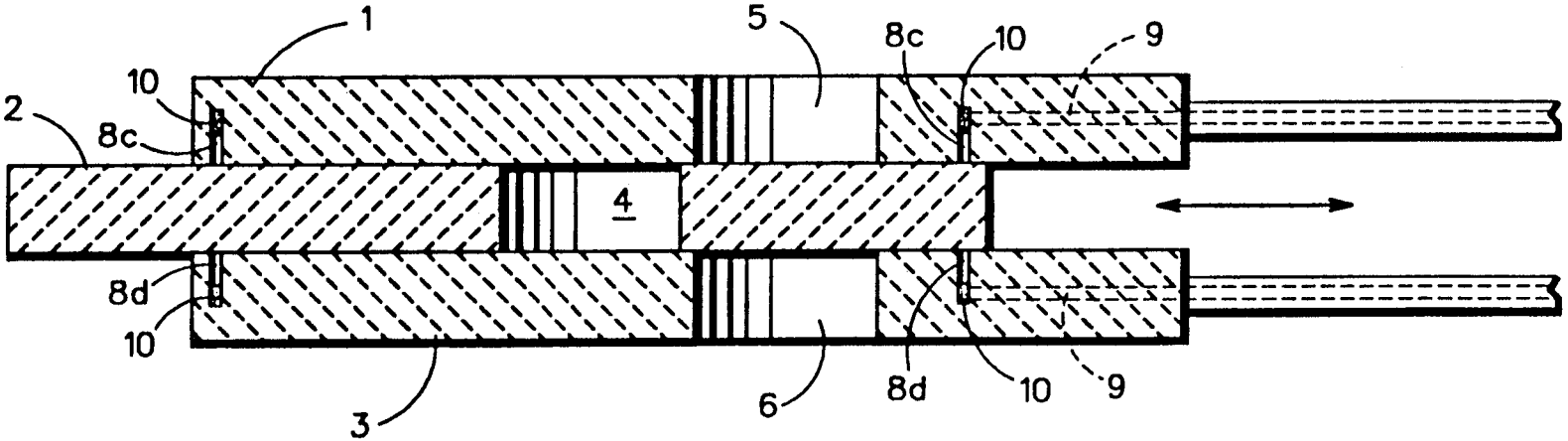
FIG. 2 is a schematic sectional elevation view of a second type of sliding gate valve of this invention.

Referring to FIGS. 1 and 2, there is illustrated a schematic sectional view of three plate slide gate valves in which an upper refractory plate 1 and a lower refractory plate 3 are stationary and fixed to the underside of a ladle or tundish in a steel frame (not shown). A middle refractory plate 2 is reciprocable to allow molten metal orifice 4 to move in and out of registry with molten metal orifices 5 and 6 in stationary plates 1 and 3, respectively, to control the flow of molten metal.

Figure 3:
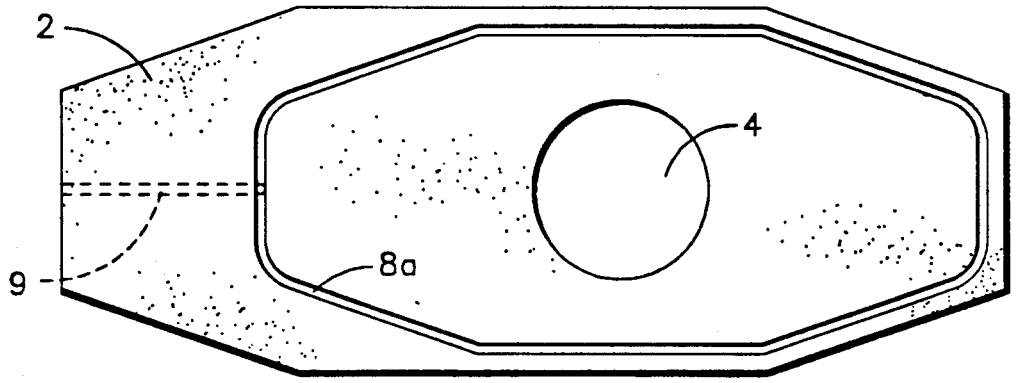
FIG. 3 is a top view of the reciprocal slide plate of the sliding gate valve shown in FIG. 1.
Figure 4:
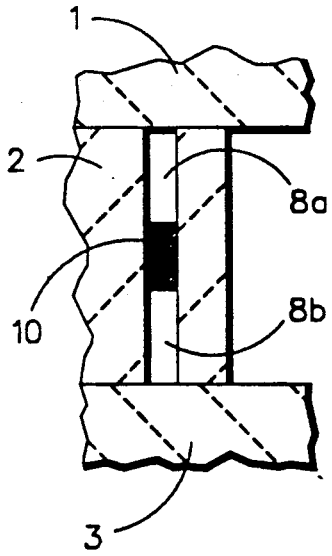
FIG. 4 is a sectional view of a portion of the reciprocal slide plate of the sliding gate valve shown in FIG. 1.

FIGS. 3 and 4 illustrate a face of the reciprocal middle plate 2 according to my invention illustrated in FIG. 1 with its molten metal orifice 4 centrally located therein. Extending around the periphery of the orifice 4 s both the top and bottom faces of the reciprocal plate 2 and a pair of shallow, continuous grooves 8 and 8a of lengths sufficient to completely surround the molten metal orifice 4 of the reciprocal plate 2 in all of its adjustable in and out positions. Plate 2 also has a passageway 9 drilled into the end of plate 2 which is connected to a source of pressurized nonoxidizing gas, such as argon. A porous refractory member 10 is cast or inserted into the middle of plate 2 feeding the gas from the passageway 9 uniformly to both the upper and lower grooves 8 and 8a. This porous insert 10 is preferably cast in the plate 2 during its manufacture.

Figure 5:
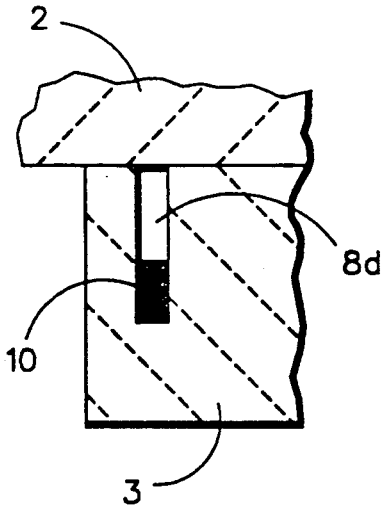
FIGS. 5 and 6 are section views of a portion of the top and bottom plates of the sliding gate valve shown in FIG. 2.
Figure 6:
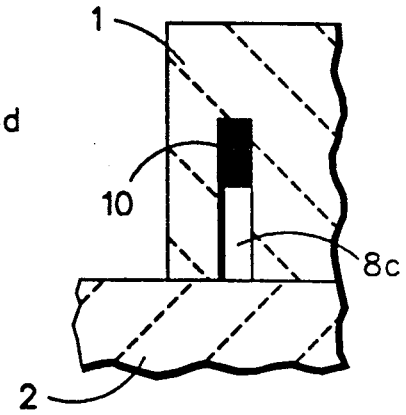

A second embodiment of my invention is illustrated in schematic sectional views FIG. 2 and FIGS. 5 and 6 in which the grooves 8c and 8d are put in the lower face of the upper stationary plate 1 and the upper face of the lower stationary plate. At the base of each of the grooves 8c and 8d there is a porous refractory material or insert 10 connected to gas passageways 9 drilled into plates 1 and 3 and connected to a source of pressurized nonoxidizing gas.

The refractory plates of my invention can be used in both two plate and three plate sliding gate valves as will be apparent to one skilled in the manufacture of slide gate valves.

The porous inserts 10 have been discovered to feed the nonoxidizing gas more uniformly into the grooves 8 than grooved plates without the porous refractory insert 10. This feature insures a continuous flow of nonoxidizing gas completely around the molten metal orifices 4, 5 and 6 especially where dirt or solidified molten metal may clog portions of the groove. While the use of a plain groove 8 has been described in my earlier U.S. patent application Ser. No. 509,683 filed Apr. 16, 1990 for "Molten Metal Slide Gate Valve" and porous inserts without a groove have been described in U.S. Pat. No. 4,789,086 issued Dec. 6, 1988, the synergistic effect of using a porous refractory insert at the base of the groove has not been suggested and has resulted in a very effective means for preventing the infiltration of objectionable air into the molten metal orifices of the slide gate valve. While slide gate plates according to my invention are more expensive to manufacture than conventional slide gate plates, the superior results more than offset the added manufacturing expense.

I claim:

1. A sliding gate valve for controlling the flow of molten metal comprising a stationary upper refractory plate member having a molten metal orifice, a stationary lower refractory plate member having a molten metal orifice and a reciprocable refractory plate member having a molten metal orifice and positioned between said stationary upper refractory plate member and said stationary lower refractory plate member, the top and bottom faces of said reciprocable refractory plate member each having a shallow open groove extending around the entire periphery of the molten metal orifice in said plate and means common to the base of each groove for introducing a flow of nonoxidizing gas into each of said grooves.

2. The sliding gate valve of claim 1 in which the means for introducing a flow of nonoxidizing gas into said grooves is porous refractory material connecting said grooves to a source of nonoxidizing gas.

3. The sliding gate valve of claim 1 in which the nonoxidizing gas is argon.

4. A sliding gas valve for controlling the flow of molten metal comprising a stationary upper refractory plate member having a molten metal orifice, a stationary lower refractory plate member having a molten metal orifice and a reciprocable refractory plate member having a molten metal orifice and positioned between said stationary upper refractory plate member and said stationary lower refractory plate member, the bottom face of said upper refractory plate member and the top face of said lower refractory plate member each having a shallow open groove extending around the entire periphery of the molten metal orifice in the plate and means common to the base of each groove for introducing a flow of nonoxidizing gas into each of said grooves.

5. The sliding gate valve of claim 4 in which the means for introducing a flow of nonoxidizing gas into said grooves is a porous refractory material connecting said grooves to a source of nonoxidizing gas.

* * * * *